US010098797B2

(12) United States Patent
Hutchison et al.

(10) Patent No.: US 10,098,797 B2
(45) Date of Patent: Oct. 16, 2018

(54) ENDBOARD FOR A PERSON SUPPORT APPARATUS

(71) Applicant: Hill-Rom Services, Inc., Batesville, IN (US)

(72) Inventors: Stephen E. Hutchison, Batesville, IN (US); Richard H. Heimbrock, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 151 days.

(21) Appl. No.: 14/534,139

(22) Filed: Nov. 5, 2014

(65) Prior Publication Data

US 2015/0128344 A1 May 14, 2015

Related U.S. Application Data

(60) Provisional application No. 61/900,006, filed on Nov. 5, 2013.

(51) Int. Cl.
*A61G 7/05* (2006.01)
*A47C 19/02* (2006.01)

(52) U.S. Cl.
CPC ..... *A61G 7/0506* (2013.01); *A47C 19/022* (2013.01)

(58) Field of Classification Search
CPC ..... A61G 7/0506; A47C 19/022
See application file for complete search history.

(56) References Cited

U.S. PATENT DOCUMENTS 608,545 A * 8/1898 Coburn ..... A47C 19/022 5/238
1,563,002 A * 11/1925 Weisman ..... A47C 19/022 5/131
1,632,524 A * 6/1927 Weisman ..... A47C 19/022 228/164
1,639,847 A * 8/1927 Greenman ..... A47C 19/022 5/131
3,590,403 A * 7/1971 Mixon ..... A47D 7/00 5/100
3,644,948 A * 2/1972 Fredman ..... A47C 19/022 5/131
3,793,655 A * 2/1974 Harris ..... A47C 19/022 5/296
5,790,994 A * 8/1998 Leonard ..... A47C 19/005 5/183
8,370,977 B2 * 2/2013 Newkirk ..... A61G 7/018 248/176.1
2007/0296600 A1 * 12/2007 Dixon ..... A61G 7/05 340/573.1
2009/0113627 A1 * 5/2009 Harrow ..... A47C 19/005 5/200.1

(Continued)

*Primary Examiner* — Nicholas F Polito
(74) *Attorney, Agent, or Firm* — Barnes & Thornburg LLP

(57) ABSTRACT

A person-support apparatus comprises a frame configured to support a person thereon, and an endboard assembly configured to be removably coupled to the frame. The endboard assembly includes an endboard assembly including an endboard body and a plurality of support members that are configured to removably couple the endboard body to the frame in a use position and cooperate to maintain the endboard body in an upright orientation when the endboard assembly is uncoupled from the frame and in a storage position.

17 Claims, 11 Drawing Sheets

(56) References Cited

U.S. PATENT DOCUMENTS

| | | | | |
|---|---|---|---|---|
| 2010/0263123 | A1* | 10/2010 | Newkirk | A61G 7/018 5/503.1 |
| 2012/0023659 | A1* | 2/2012 | Zerhusen | A61G 7/0506 5/12.1 |
| 2012/0023675 | A1* | 2/2012 | Hutchison | A61G 7/0506 5/624 |

* cited by examiner

ENDBOARD FOR A PERSON SUPPORT APPARATUS

This Application claims priority to U.S. Provisional Application Ser. No. 61/900,006 titled ENDBOARD FOR A PERSON SUPPORT APPARATUS filed on Nov. 5, 2013, the contents of which are incorporated herein by reference.

BACKGROUND OF THE DISCLOSURE

This disclosure relates generally to endboards for person support apparatuses. More particularly, but not exclusively, one illustrative embodiment relates to an endboard assembly that can maintain an upright orientation when disconnected from a person support apparatus.

Caregivers remove endboards from person support apparatuses for a variety of reasons, including, but not limited to, enabling a person support apparatus to move to a chair egress position. After the endboard is removed, it is stored until the caregiver is ready to re-connect it to the person support apparatus. While various endboards have been developed, there is still room for improvement. Thus a need persists for further contributions in this area of technology.

SUMMARY OF THE DISCLOSURE

One illustrative embodiment of the present disclosure includes an endboard with a plurality of support members configured to maintain the endboard in an upright orientation when the endboard is not attached to the person support apparatus.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

Referring now to the illustrative examples in the drawings, wherein like numerals represent the same or similar elements throughout.

DETAILED DESCRIPTION OF THE DRAWINGS

Figure 1:
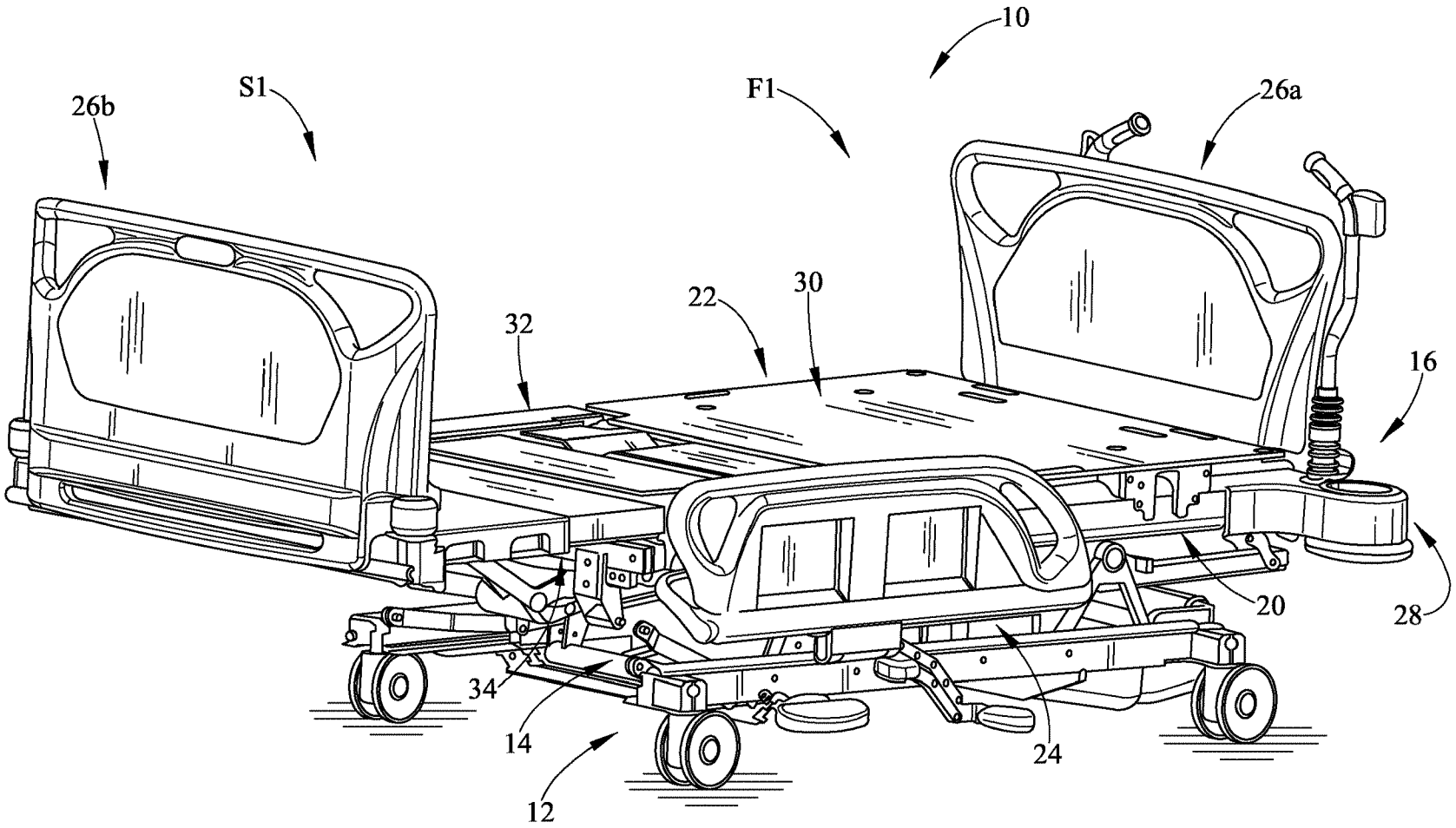
FIG. 1 is a perspective side view of a person support apparatus according to one illustrative embodiment of the current disclosure.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

A person support apparatus 10 according to one illustrative embodiment of the current disclosure is shown in FIGS. 1-12. In one contemplated embodiment, the person support apparatus 10 is a hospital bed with a first section F1 or head support section F1, where the head of a person (not shown) can be positioned, and a second section S1 or a foot support section S1, where the feet of the person (not shown) can be positioned. In other contemplated embodiments, the person support apparatus 10 can be a hospital stretcher, an operating table, or other apparatus configured to support a person. The person support apparatus 10 includes a lower frame 12 or base 12, a plurality of supports 14 coupled to the lower frame 12 and an upper frame 16 movably supported by the plurality of supports 14 above the lower frame 12. In one illustrative embodiment, the supports 14 are lift mechanisms 14 that move the upper frame 16 with respect to the lower frame 12. In some contemplated embodiments, the person support apparatus 10 supports a person support surface (not shown) on the upper frame 16.

Figure 2:
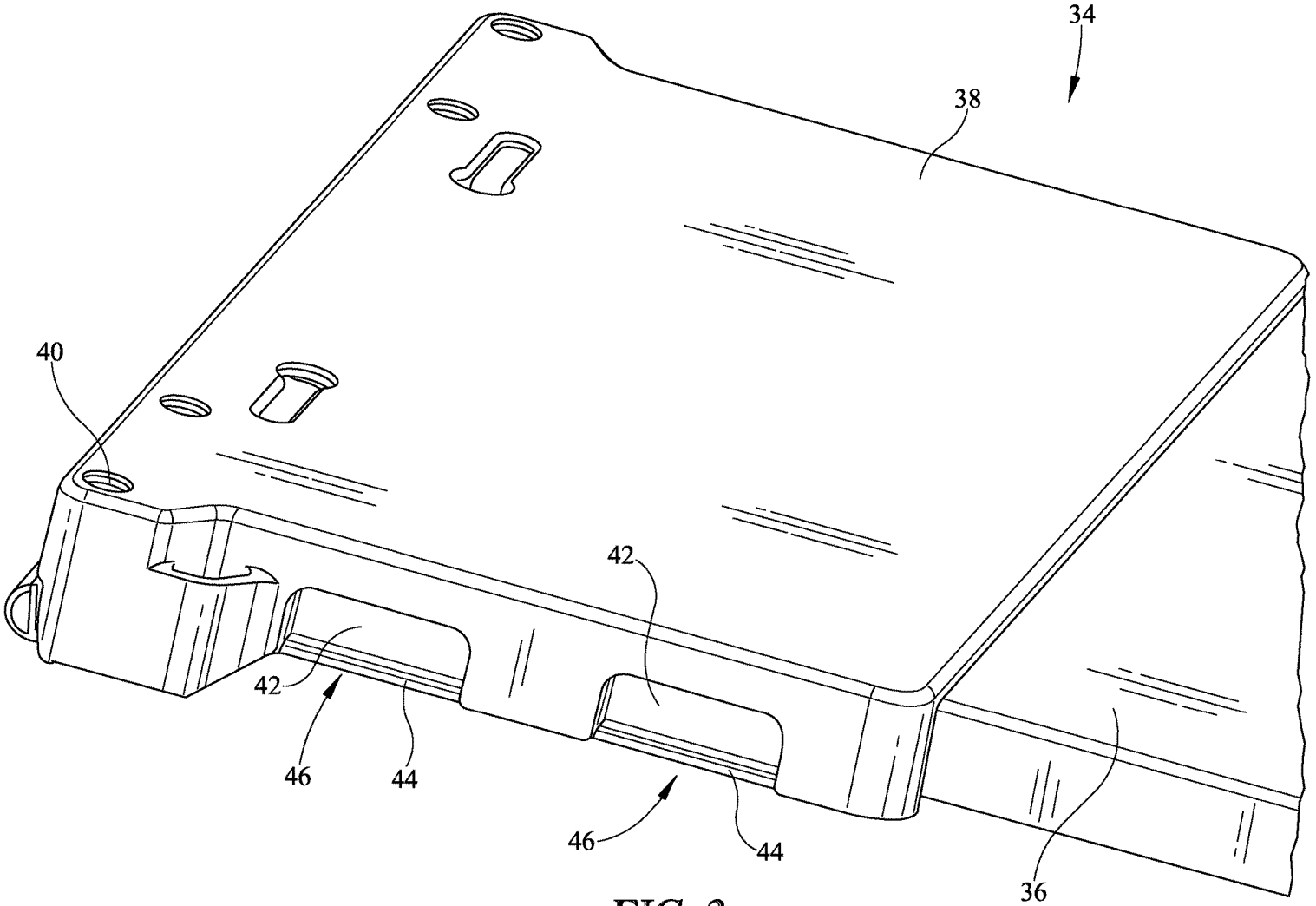
FIG. 2 is a perspective side view of a foot deck section of the person support apparatus of FIG. 1.
Figure 3:
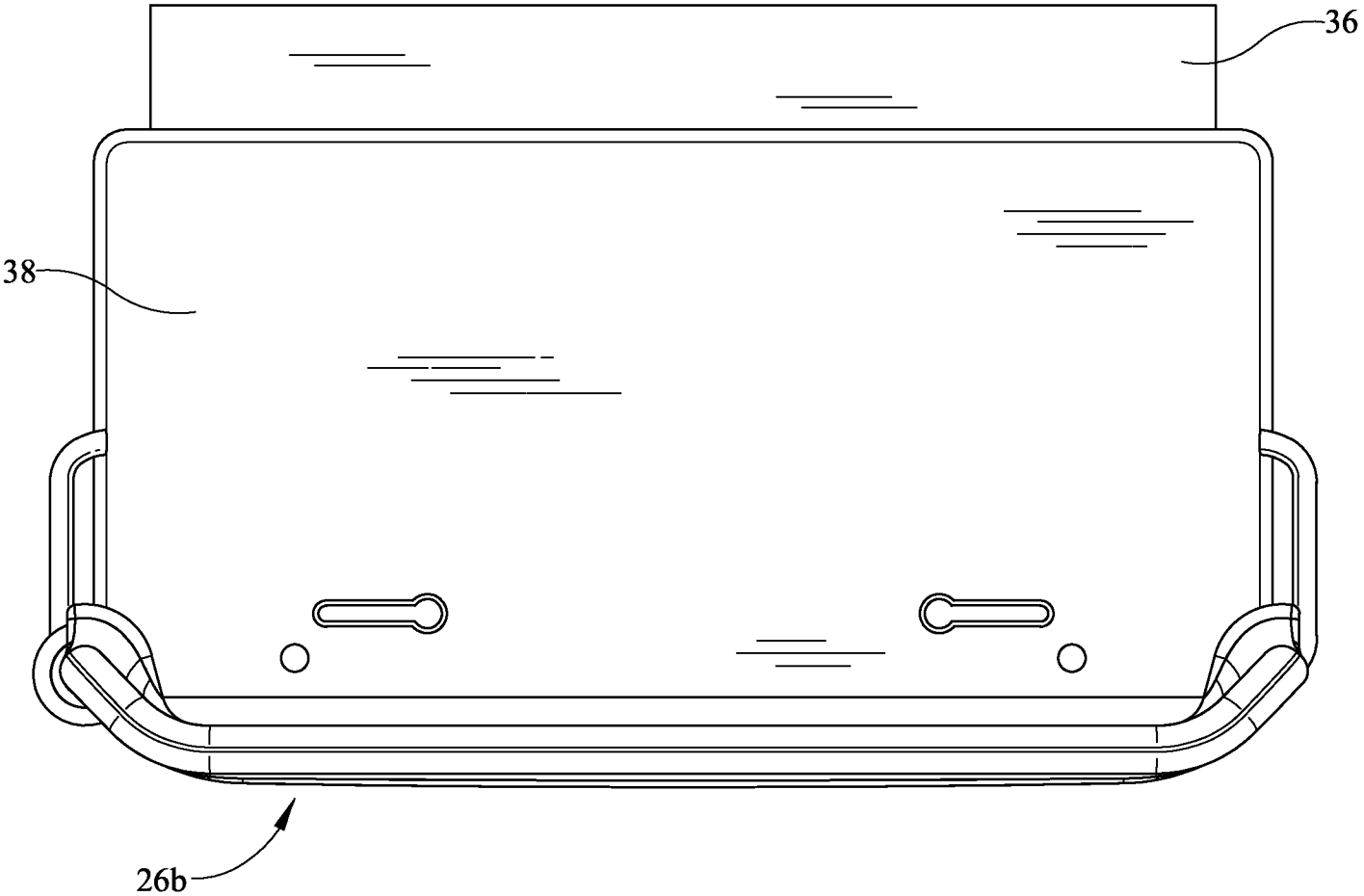
FIG. 3 is a top view of the foot deck section of FIG. 2 with a foot endboard according to one illustrative embodiment of the current disclosure coupled thereto.
Figure 4:
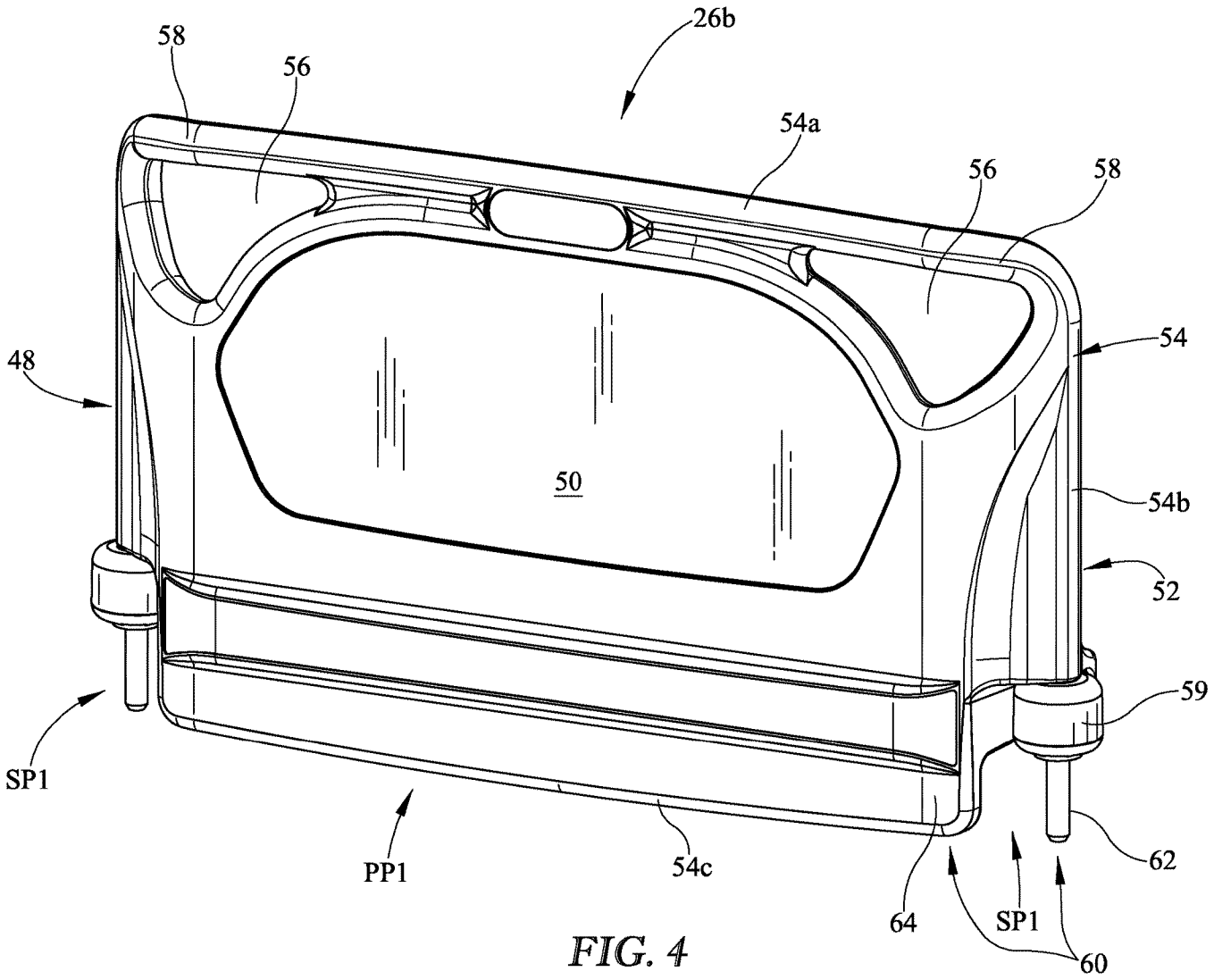
FIG. 4 is a perspective side view of the foot endboard of FIG. 3.
Figure 5:
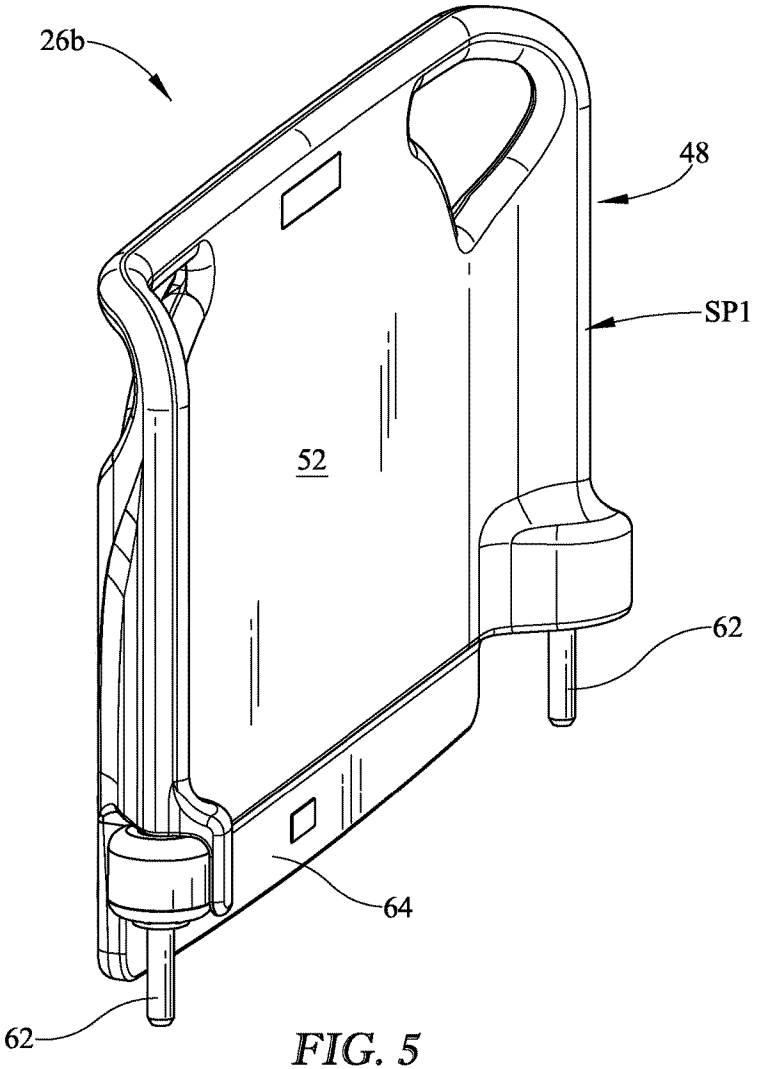
FIG. 5 is a perspective side perspective view of the foot endboard of FIG. 3 maintained in a substantially vertical orientation on a floor.
Figure 6:
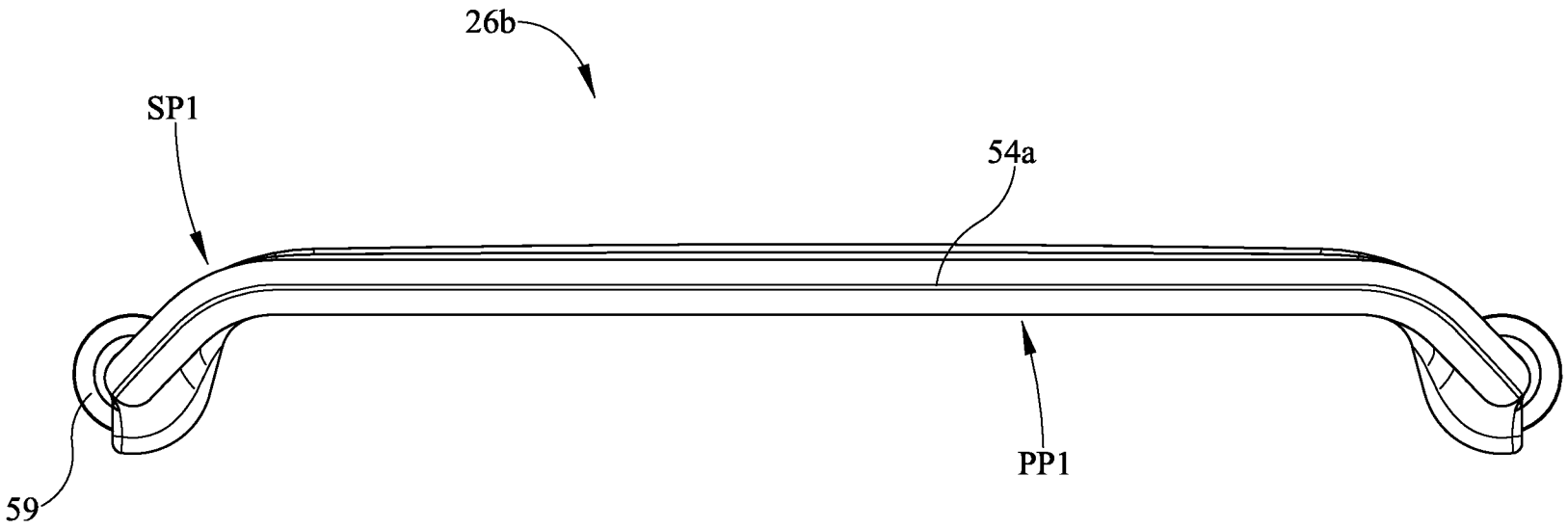
FIG. 6 is a top view of the foot endboard of FIG. 3.
Figure 7:
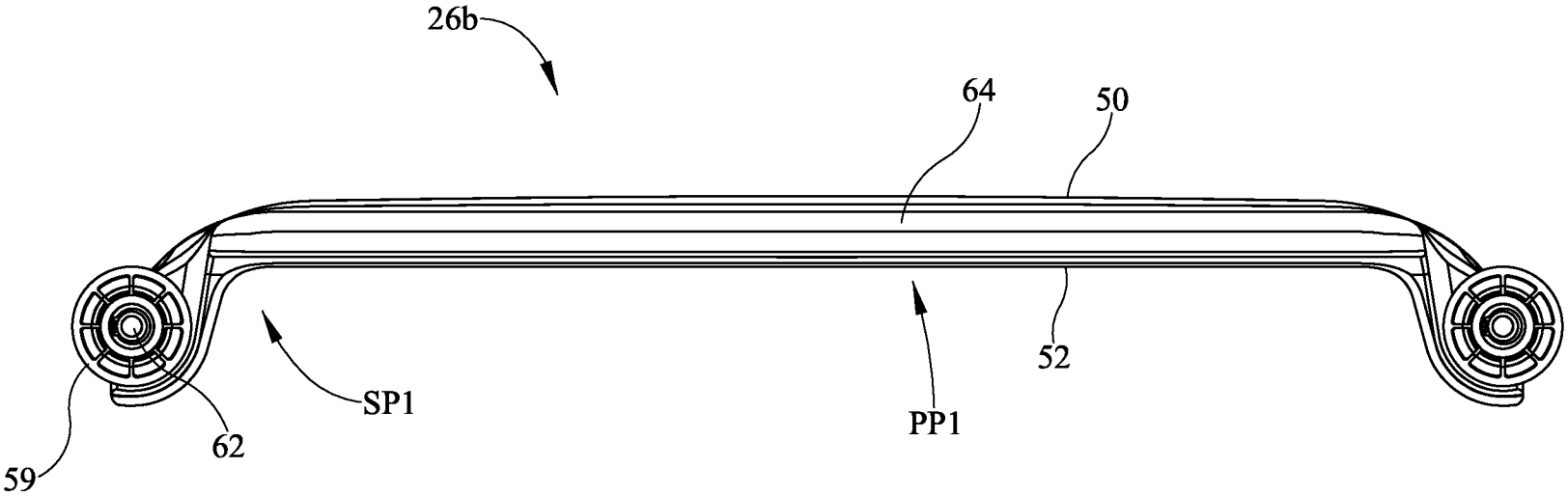
FIG. 7 is a bottom view of the foot endboard of FIG. 3.
Figure 8:
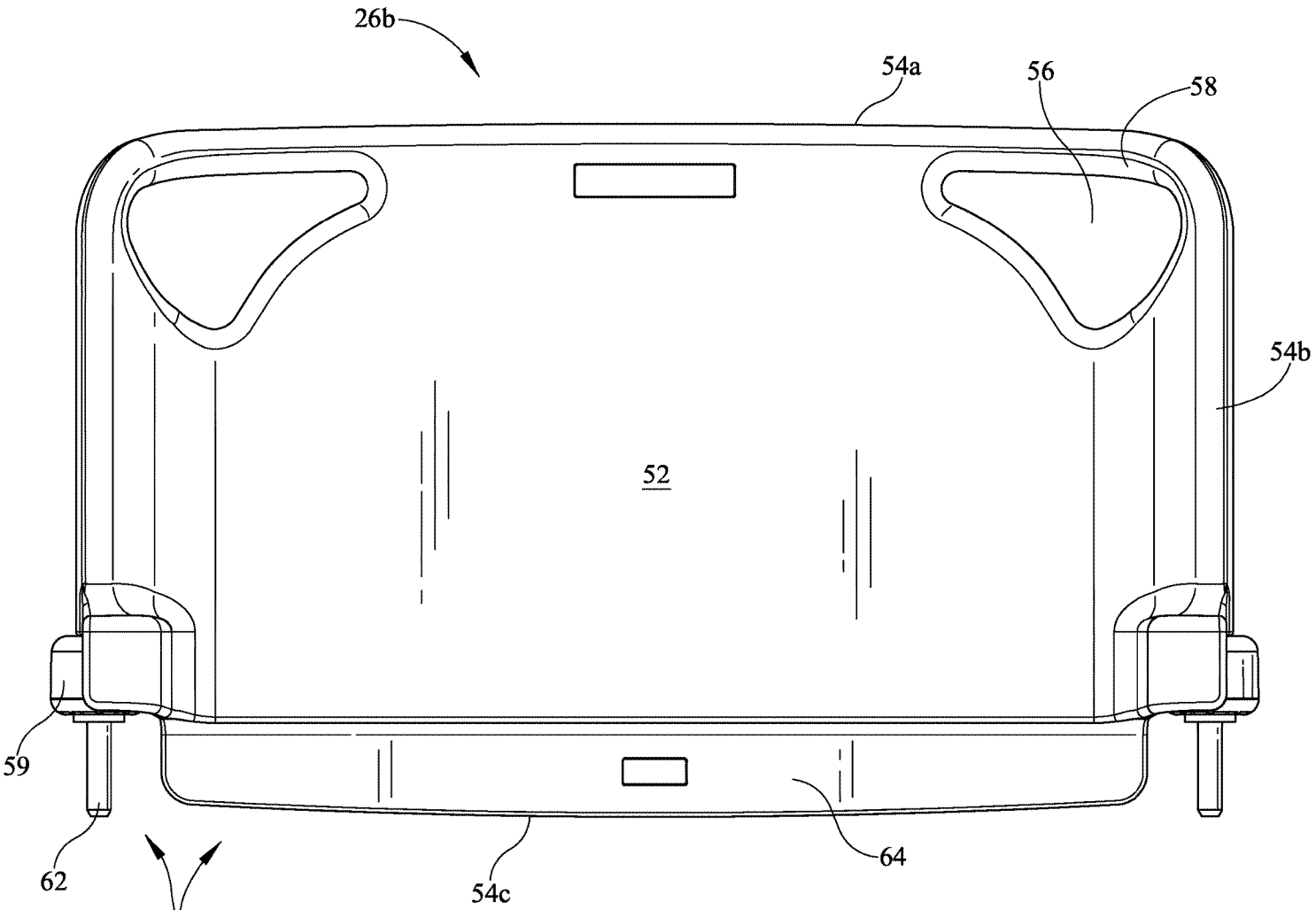
FIG. 8 is a rear view of the foot endboard of FIG. 3.
Figure 9:
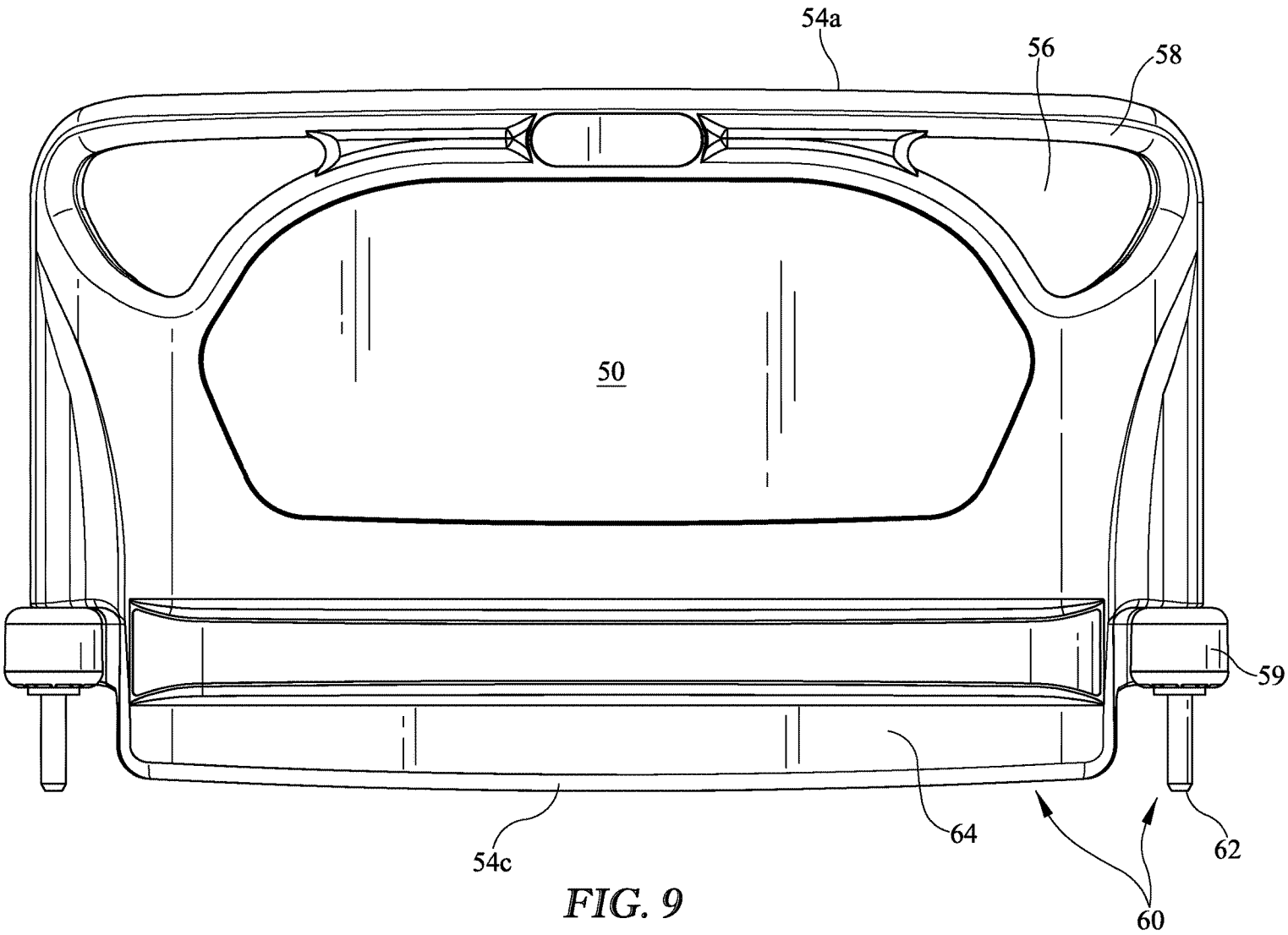
FIG. 9 is a front view of the foot endboard of FIG. 3.
Figure 10:
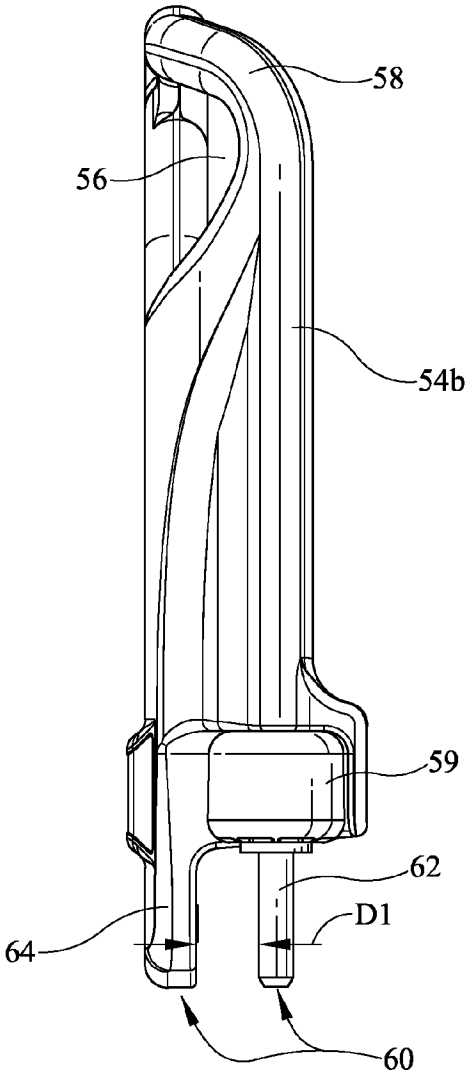
FIG. 10 is a side view of the foot endboard of FIG. 3.
Figure 11E:
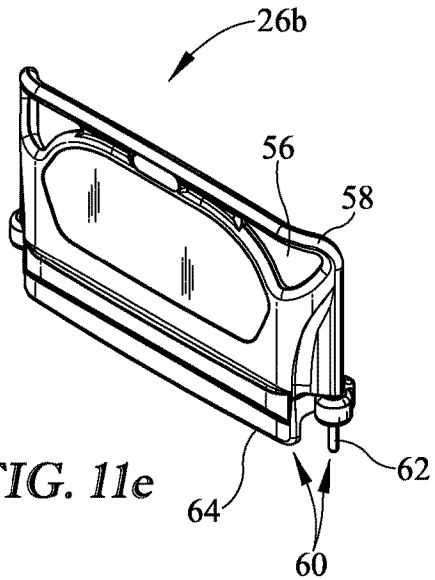
FIG. 11*e* is another perspective view of the foot endboard of FIG. 3
Figure 11D:
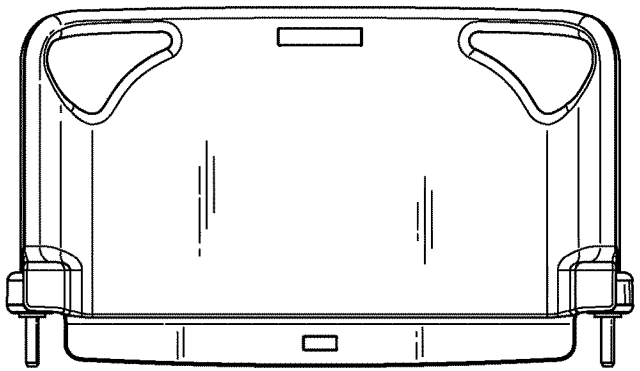
FIG. 11*d* is another rear view of the foot endboard of FIG. 3
Figure 12:
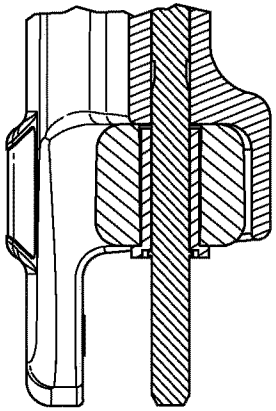
FIG. 12 is partial side sectional view of the foot endboard of FIG. 3
Figure 11C:
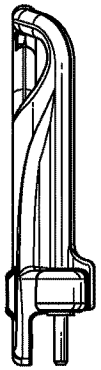
FIG. 11*c* is another side view of the foot endboard of FIG. 3
Figure 11A:
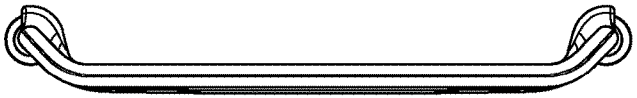
FIG. 11*a* is another top view of the foot endboard of FIG. 3.
Figure 11B:
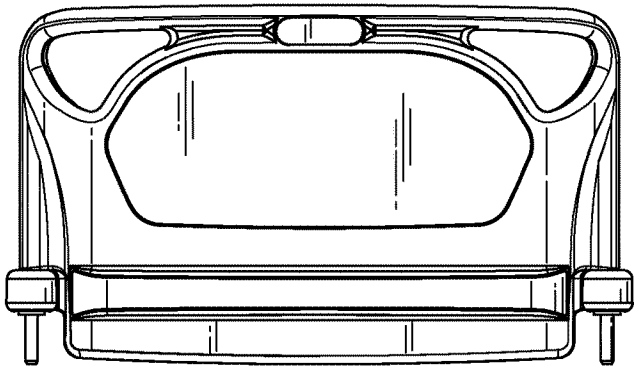
FIG. 11*b* is another front view of the foot endboard of FIG. 3

The upper frame 16 includes an upper frame base 20, a deck 22, siderails 24, endboards 26 (including a head endboard 26*a* and a foot endboard 26*b*), and an accessory support 28 as shown in FIGS. 1-6. The upper frame base 20 is coupled to the supports 14 and supports the deck 22, the siderails 24, the endboards 26, and the accessory support 28. The deck 22 includes a head portion 30, a seat portion 32, and a foot portion 34 as shown in FIGS. 1-2. The head portion 30, the seat portion 32, and the foot portion 34 are movably coupled to each other and the upper frame base 20 and are configured to cooperate with one another to move the deck 22 between a relatively horizontal position and a chair position (not shown). In other contemplated embodiments, the deck 22 is configured to move between a relatively horizontal position and a reclined position (not shown).

The foot portion 34 includes a first section 36 and a second section 38 movable with respect to the first section 36. In one illustrative embodiment, the second section 38 partially overlaps the top of the first section 36 and moves with respect to the first section 36 to increase and/or decrease the length of the foot portion 34. The second section 38 includes endboard receptacles 40, a recessed area 42, and a bracket 44 coupled proximate to the recessed area 42 to define an accessory hanger 46.

The foot endboard 26*b* is coupled to the foot portion 34 of the deck 22 via the endboard receptacles 40. The foot endboard 26*b* includes an endboard body 48 with a substantially planar portion PP1 and side portions SP1 that extend from the substantially planar portion PP1 and curve along the perimeter of the deck 22 toward the patient support area. The endboard body 48 includes a first surface 50 or front surface 50, a second surface 52 or back surface 52, and a side surface 54 or perimeter edge 54 extending between the first surface 50 and the second surface 52. The endboard body 48 also includes openings 56 along the upper portion of the endboard body 48 that extend through the endboard body 48 and cooperate with the upper perimeter edge 54*a* to define grips 58. In some contemplated embodiments, the openings 56 cooperate with the side perimeter edge 54*b* and/or upper perimeter edge 54*a* to define the grips 58. In some contemplated embodiments, the foot endboard 26*b* also includes roller bumpers 59 coupled thereto and configured to be rotatable with respect to the endboard body 48.

The endboard body 48 also includes a plurality of support members 60 along the lower portion of the endboard body 48. In one contemplated embodiment, the support members 60 are configured to couple the foot endboard 26*b* to the foot portion 34 of the deck 22, and are configured to be offset from one another in such a way that when the foot endboard 26*b* is moved from a use position (where the foot endboard 26*b* is coupled to the foot portion 34 of the deck 22) to a storage position (where the foot endboard 26*b* is uncoupled from the deck 22 and is, in one example, placed on the floor of the hospital room) the endboard body 48 is maintained in a substantially vertical orientation by the support members 60. In some contemplated embodiments, the endboard body 48 is maintained in a standing orientation, which includes can include maintenance of the endboard body in a substantially vertical orientation. Enabling the foot endboard 26*b* to maintain itself in a substantially vertical orientation in the storage position may help reduce the amount of space the foot endboard 26*b* occupies in a hospital room and may help keep the foot endboard 26*b* out of the movement path of the caregiver, patient, and/or equipment. Also, it may help prevent a caregiver from having to search for a place to store the foot endboard 26*b* while tending to the patient and may help make it more clearly accessible when the caregiver is ready to re-couple it to the foot portion 34.

In some contemplated embodiments, the support members 60 include two posts 62 coupled to the curved side portions SP1 and an extension 64 extending downwardly from the substantially planar portion PP1 and define the lower perimeter edge 54*c* of the endboard body 48. In other contemplated embodiments, the support members 60 include at least one additional post in lieu of the extension 64. In still other contemplated embodiments, the support members 60 can include other weight bearing elements that are offset from the centerline of the foot endboard 26*b* a distance D1. The extension 64 and the two posts 62 offset therefrom cooperate to provide three points of contact that enable the foot endboard 26*b* to balance when placed on a substantially planar surface, like a floor of a hospital room. In some contemplated embodiments the posts 62 and the extension 64 are substantially the same length.

Many other embodiments of the present disclosure are also envisioned. For example, a person-support apparatus comprises a frame configured to support a person thereon, and an endboard assembly including an endboard body and a plurality of support members that are configured to removably couple the endboard body to the frame in a use position and cooperate to maintain the endboard body in an upright orientation when the endboard assembly is uncoupled from the frame and in a storage position.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless cannot be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles can have been presented, they need not be utilized in combination, and various combinations of inventive aspects and principles are possible in light of the various embodiments provided above.

What is claimed is:

1. An endboard assembly for use with a person support structure that includes a frame, comprising, an endboard body including a main body portion arranged along an endboard plane, a first curved side portion coupled to a first side of the main body portion and curving away from the main body portion toward the person support structure, and a second curved side portion coupled to a second side of the main body portion and curving away from the main body portion toward the person support structure; and a plurality of supports including a first post coupled to the first curved side portion offsetfrom the endboard plane, a second post coupled to the second curved side portion offset from the endboard plane, and an extension extending downward from the main body portion and arranged between the first curved side portion and the second curved side portion, wherein the first post, the second post, and the extension are configured to engage the frame of the person support structure to couple the endboard to the person support structure while in a use position where the endboard assembly is spaced apart from and is suspended above a floor surface, and are configured to balance the endboard in a substantial vertical position on a floor surface in a storage position when the endboard is separated from the frame.

2. The endboard assembly of claim 1, wherein the endboard body is maintained in a standing orientation when the endboard assembly is in the storage position.

3. The endboard assembly of claim 1, wherein the first post and the second post are offset from the main body portion.

4. The endboard assembly of claim 1, wherein the first post, the second post, and the extension are substantially the same length.

5. The endboard assembly of claim 1, wherein the extension includes a third post extending from the main body portion.

6. The endboard assembly of claim 1, wherein the endboard body includes a substantially planar central portion formed to include an opening therein to provide a grip.

7. The endboard assembly of claim 1 further comprising a bumper coupled to at least one of the plurality of supports.

8. A person-support apparatus, comprising:

a frame configured to support a person thereon, an endboard including an endboard body, a first curved side, and a second curved side, and a plurality of support members configured to removably couple the endboard body to the frame in a use position and to cooperate to maintain the endboard body in a vertical standing orientation when the endboard is uncoupled from the frame and positioned on a floor surface in a storage position, wherein the support members include a first post coupled to the first curved side, a second post coupled to the second curved side, and an extension extending downward from the endboard body, and wherein when the endboard is supported on the frame in the use position, the endboard is spaced apart from and is suspended above the floor surface, and wherein when the endboard is supported on the floor surface in the storage position, only the support members contact the floorsurface.

9. The person-support apparatus of claim 8, wherein the extension is defined by a portion of the endboard body.

10. The person-support apparatus of claim 8, wherein the plurality of support members includes at least two support members being offset from a centerline of the endboard.

11. The person-support apparatus of claim 8, wherein the endboard body further includes a top portion, a bottom portion, and a substantially planar central portion formed to include an opening therein to provide a grip.

12. The person-support apparatus of claim 8, wherein the endboard includes a bumper coupled to at least one of the plurality of support members.

13. An endboard assembly for use with a person support structure that includes a frame, comprising:

an endboard body arranged along an endboard plane, and a plurality of endboard supports configured to removably couple the endboard body to a structure when the endboard assembly is in a use position, wherein the plurality of endboard supports include a first post coupled to a first side of the endboard body, a second post coupled to a second side of the endboard body, and an extension, and the plurality of endboard supports are configured to cooperate to maintain the endboard assembly in a standing orientation when the endboard assembly is in a storage position, and the endboard assembly is supported on the frame in the use position where the endboard assembly is spaced apart from and is suspended above the floor surface, and is supported by the floor surface in the storage position, and wherein the first post and the second post are arranged outside the endboard plane and the extension extends downward from the endboard body along the endboard plane.

14. The endboard assembly of claim 13, wherein the plurality of the endboard supports are substantially the same length.

15. The endboard assembly of claim 13, wherein at least one of the plurality of endboard supports is defined by a portion of the endboard body.

16. The endboard assembly of claim 13, wherein the endboard body includes curved side portions and a substantially planar central portion formed to include an opening therein to provide a grip, at least one of the plurality of endboard supports is coupled to each of the curved side portions.

17. The endboard assembly of claim 13, wherein the endboard body is maintained in a substantially vertical orientation when the endboard assembly is in a standing orientation.

* * * * *